US007258122B2

(12) United States Patent
Okamoto

(10) Patent No.: US 7,258,122 B2
(45) Date of Patent: Aug. 21, 2007

(54) ROD-SHAPED ARTICLE FORMING DEVICE

(75) Inventor: Hiroshi Okamoto, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 567 days.

(21) Appl. No.: 10/786,131

(22) Filed: Feb. 26, 2004

(65) Prior Publication Data

US 2004/0163656 A1 Aug. 26, 2004

Related U.S. Application Data

(63) Continuation of application No. PCT/JP02/09816, filed on Sep. 25, 2002.

(30) Foreign Application Priority Data

Sep. 27, 2001 (JP) ..... 2001-297088

(51) Int. Cl.
*A24C 5/14* (2006.01)
*A24C 5/31* (2006.01)

(52) U.S. Cl. ..... 131/60; 198/847; 131/27.1; 131/58; 131/66.1; 493/302

(58) Field of Classification Search ..... None
See application file for complete search history.

(56) References Cited

U.S. PATENT DOCUMENTS 1,885,943 A * 11/1932 Patterson ..... 131/66.1
2,593,284 A * 4/1952 Ewell ..... 198/847

FOREIGN PATENT DOCUMENTS

| | | | |
|---|---|---|---|
| EP | 0 879 564 | A1 | 11/1998 |
| JP | 8-214854 | A | 8/1996 |
| JP | 9-289884 | A | 11/1997 |
| WO | WO 00/08959 | A1 | 2/2000 |

* cited by examiner

*Primary Examiner*—Steven Griffin
*Assistant Examiner*—Michael J. Felton
(74) *Attorney, Agent, or Firm*—Birch, Stewart, Kolasch & Birch, LLP

(57) ABSTRACT

A forming device applied to a cigarette manufacturing machine causes a garniture tape 10 to travel through a wrapping section 8, and meanwhile wraps a shredded tobacco layer T in wrapping paper P to form continuously a cigarette rod R. The tape 10 is guided to travel by a forming guide 18 in the wrapping section 8, and is simultaneously bent to have a cross section of an arc that is downward convex. On the other hand, the travel of the tape 10 is guided by a pair of guide rollers 24 in upstream and downstream sides of the wrapping section 8, and the tape 10 is bent to have a cross section of an arc that is upward convex by guide surfaces of the rollers 24. Thus, difference of travel length, that is generated between both side edges and the central part of the tape 10 in the wrapping section 8, is offset by the guide rollers 24.

2 Claims, 5 Drawing Sheets

ROD-SHAPED ARTICLE FORMING DEVICE

This application is a Continuation of copending PCT International Application No. PCT/JP02/09816 filed on Sep. 25, 2002, which designated the United States, and on which priority is claimed under 35 U.S.C § 120, the entire contents of which are hereby incorporated by reference; and claims the benefit of Japanese Patent Document No. JP2001-297088, filed on Sep. 27, 2001 in Japan, the entirety of which is hereby incorporated by reference.

TECHNICAL FIELD

The present invention relates to a rod-shaped article forming device for wrapping in wrapping paper a material to be wrapped, that is supplied onto the wrapping paper to form a continuous rod for rod-shaped articles.

BACKGROUND ART

A rod-shaped article forming device of the aforementioned type is applied to, for example, a cigarette manufacturing machine and a filter rod manufacturing device. As an example of the forming device, a cigarette rod forming device comprises an endless garniture tape and wraps a shred tobacco layer in wrapping paper during the travelling process of the garniture tape through a wrapping section of the cigarette manufacturing machine (refer to Patent Document 1 as an example).

(Patent Document 1)

Unexamined Japanese Patent Publication No. 8-214854 (pages 3 and 4, FIG. 1)

More specifically, the shred tobacco layer is transferred from a tobacco band onto the wrapping paper immediate before the wrapping section. At this moment, the shred tobacco layer is compressed by a compression mold including a shoe and a tongue to be gradually formed into a round rod-shape. The wrapping paper is laid on the upper surface of the garniture tape and travels with the garniture tape. In this travelling process, the wrapping paper and the shred tobacco layer are drawn into the wrapping section with the garniture tape.

The garniture tape is made of a flexible material and gradually bent with respect to a width direction thereof along a forming guide (bed) when passing through the wrapping section. At this moment, the wrapping paper is formed into a U-shape on the inner side of the garniture tape and wraps the lower portion of the shred tobacco layer formed into the round rod-shape. After seam paste is applied to one of side edges of the wrapping paper, the wrapping paper is formed into a tube by upper molds referred to as a short holder and a long holder, and both side edges of the wrapping paper are overlapped to each other to form a rod-shaped article, namely a continuous cigarette rod.

Although the above-mentioned garniture tape has strength enough to strongly pull the wrapping paper and the shred tobacco layer through the wrapping section, the useful life of the garniture tape is not eternal. After the lapse of the useful life, therefore, the garniture tape becomes non-usable. Especially in recent years, the operation speed of the cigarette manufacturing machine has been more and more increased, and accordingly the garniture tape is made to travel at high speed. As a result, the average useful life of the garniture tape is liable to become shorter.

When the useful life of the garniture tape is consumed, the useful life is expired generally with breakage therein. On the contrary, if the garniture tape is partially damaged before being broken, the tape cannot be normally utilized any more thereafter and falls into a nonusable state before the lapse of the useful life thereof. The undesired shortening of useful life of the garniture tape is attributable to the damage to the both side edges of the garniture tape and the meander of the garniture tape during the travel. For instance, if the both side edges of the garniture tape is partially cut or ripped though the central part thereof is still useful, the damage to the both side edges inhibits the normal usage of the garniture tape. It is considered that the meander of the garniture tape occurs for the reason that tension is produced intensively on either side edge of the tape for some reason to cause the garniture tape to deviate in the width direction thereof from a path on which the tape should run originally. Once the garniture tape begins to meander, it is not adjustable, and thus the tape cannot carry out a normal function.

As described above, in the technical field of a rod-shaped article forming device, it is an object to remove the factors that shorten the useful life of the garniture tape and to enable the normal usage of the garniture tape within its original useful life.

DISCLOSURE OF THE INVENTION

A rod-shaped article forming device of the present invention comprises a pair of guide members for guiding a garniture tape at upstream and downstream sides of a wrapping section with respect to a travel path of the garniture tape and providing the garniture tape, in view of a cross-section thereof, with an arc shape that is convex in reverse to the cross-sectional shape of the garniture tape bent by a forming guide. The guide members guide the garniture tape while pulling the both side edges of the tape more than the central part thereof toward the inner side of travel path so that an increased amount of tension produced on the both side edges of the garniture tape due to the guidance of the forming guide is offset.

In the above-mentioned forming device, the garniture tape passes through the wrapping section and travels around a prescribed travel path. The forming guide is located in the wrapping section to support a back surface of the garniture tape and forms the garniture tape into an arc shape in view of the cross-section thereof during a travelling process of the garniture tape, thereby causing wrapping paper to wrap a material to be wrapped. At this moment, the garniture tape is bent by the forming guide, so that the both side edges thereof are outwardly located from the travel path compared to the central part of the garniture tape and have longer travel length than the central part in the wrapping section. On the other hand, the guide members guide the garniture tape at the upstream and downstream sides of the wrapping section to form the garniture tape, in view of the cross-section thereof, into an arc shape that is convex in reverse to the cross-sectional shape of the forming guide. As a result, the both side edges of the garniture tape are located at the inner side of travel path compared to the central part, which offsets the extension of the travel length in the wrapping section.

Consequently, although the tension conventionally generates more strongly on the both side edges of the garniture tape than on the central part through the wrapping section, the present invention makes it possible to offset the increment of the tension that is produced on the both side edges of the garniture tape, so that the tension distribution of the garniture tape is uniform with respect to the width direction of the tape. This prevents the damage to the both side edges of the garniture tape and the meander thereof attributable to the nonuniform distribution of tension.

More practically, the guide members are arranged in the upstream and downstream sides of the wrapping section with the wrapping section interposed therebetween in the travel path. Each of the guide members comprises a guide roller including a guide surface having the cross-sectional shape of an arc that is convex in reverse to the cross-sectional shape defined by the forming guide in a travelling direction of the garniture tape. In this case, the outer peripheral surface of the guide roller bulges out at the central part of thereof. Therefore, the guide roller is so called as a crown (convex) roller. In cases where such guide rollers are utilized, the garniture tape tends to pass on the center of the guide rollers, thereby causing the garniture tape so-called self-aligning (centering) action.

The sectional shape of the guide surface of the guide roller is so formed that the travel length of both side edges and that of the central part of the garniture tape on the travel path are substantially same. Thus, the shape of the guide roller is properly determined according to the shape of the forming guide, so that it is possible to constantly keep the tension of the garniture tape uniform.

Furthermore, the forming device may include a positioning mechanism capable of positioning the guide rollers in a transversal direction of the travel path, once the center of each guide roller is positioned with respect to the travel path, the garniture tape itself travels while the central position thereof is maintained.

BEST MODE OF CARRYING OUT THE INVENTION

Hereinafter, an embodiment in the case that the present invention is applied to a cigarette manufacturing machine will be described.

Figure 1:
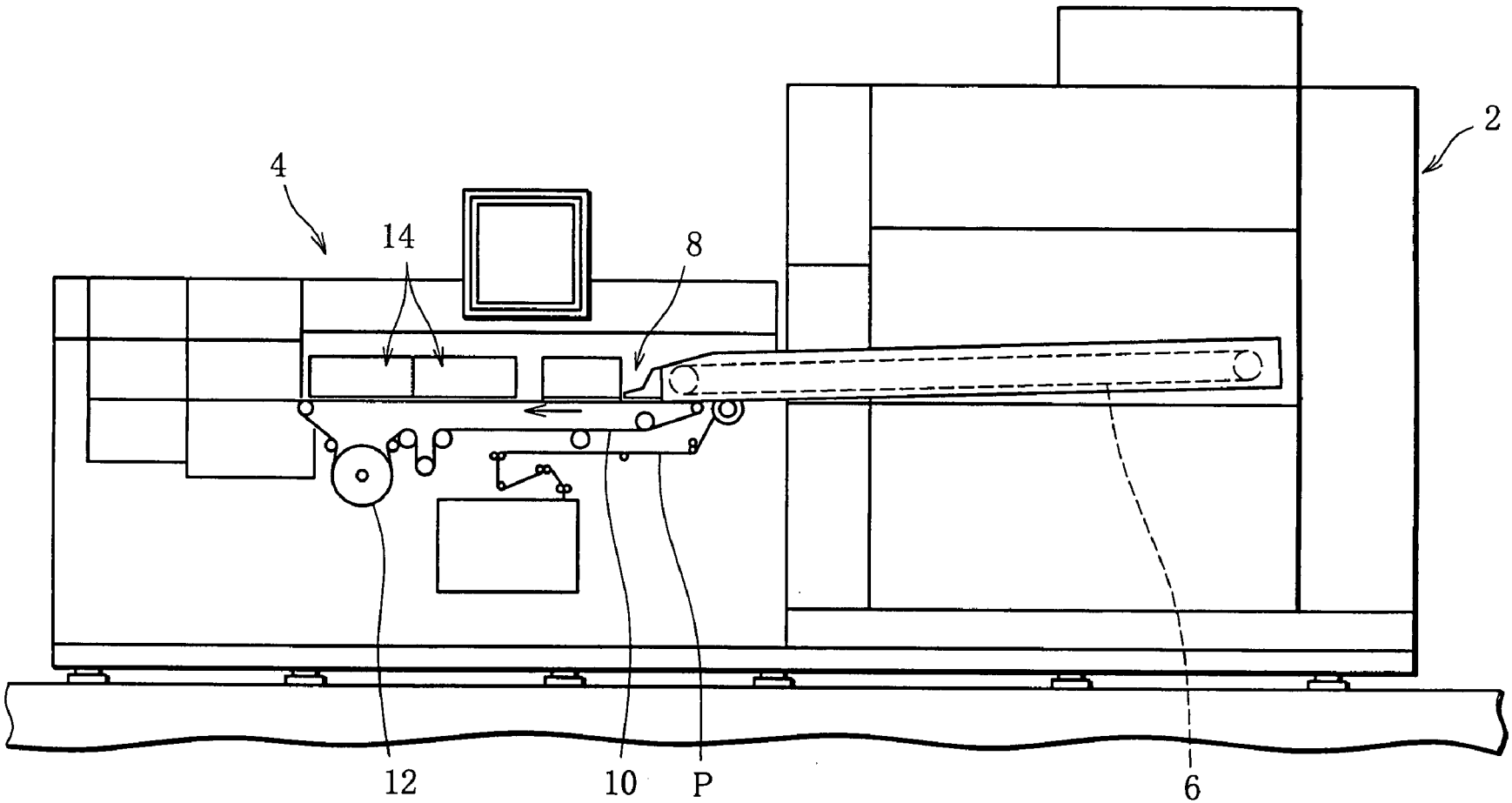
FIG. 1 is an elevation view showing a cigarette manufacturing machine to which a forming device of one embodiment is applied.

As illustrated in FIG. 1, the cigarette manufacturing machine comprises a shredded tobacco feeding device 2 and a rod forming device 4, and one embodiment of the present invention is materialized as the rod forming device 4.

The feeding apparatus 2 has a tobacco band 6 that sucks shredded tobacco as a shredded tobacco layer on a suction surface thereof and feeds the sucked shredded tobacco layer toward the rod forming device 4. In addition, the shredded tobacco layer becomes a material or filler to be wrapped that will be wrapped in wrapping paper P.

The rod forming device 4 has a wrapping section 8 extending from the tobacco band 6, and the shredded tobacco layer is wrapped in the wrapping paper P by means of the wrapping section 8. More specifically, the rod forming device 4 has an endless garniture tape 10 that is passed around or along a plurality of rollers and travels along a prescribed travel path. The garniture tape 10 is passed around a drive drum 12 on the travel path and driven by rotation of the drive drum 12 to travel through the wrapping section 8 in a direction of an arrow in the drawing. The travel path of the garniture tape 10 is once directed upward, and extends in a horizontal direction from the terminal end of the tobacco band 6. After passing through a dryer section 14 following the wrapping section 8, the travel path is bent downward and drawn by the drive drum 12. Then, after passing around the drive drum 12, the travel path of the garniture tape 10 is guided by the rollers to return to the aforementioned upward position.

Figure 2:
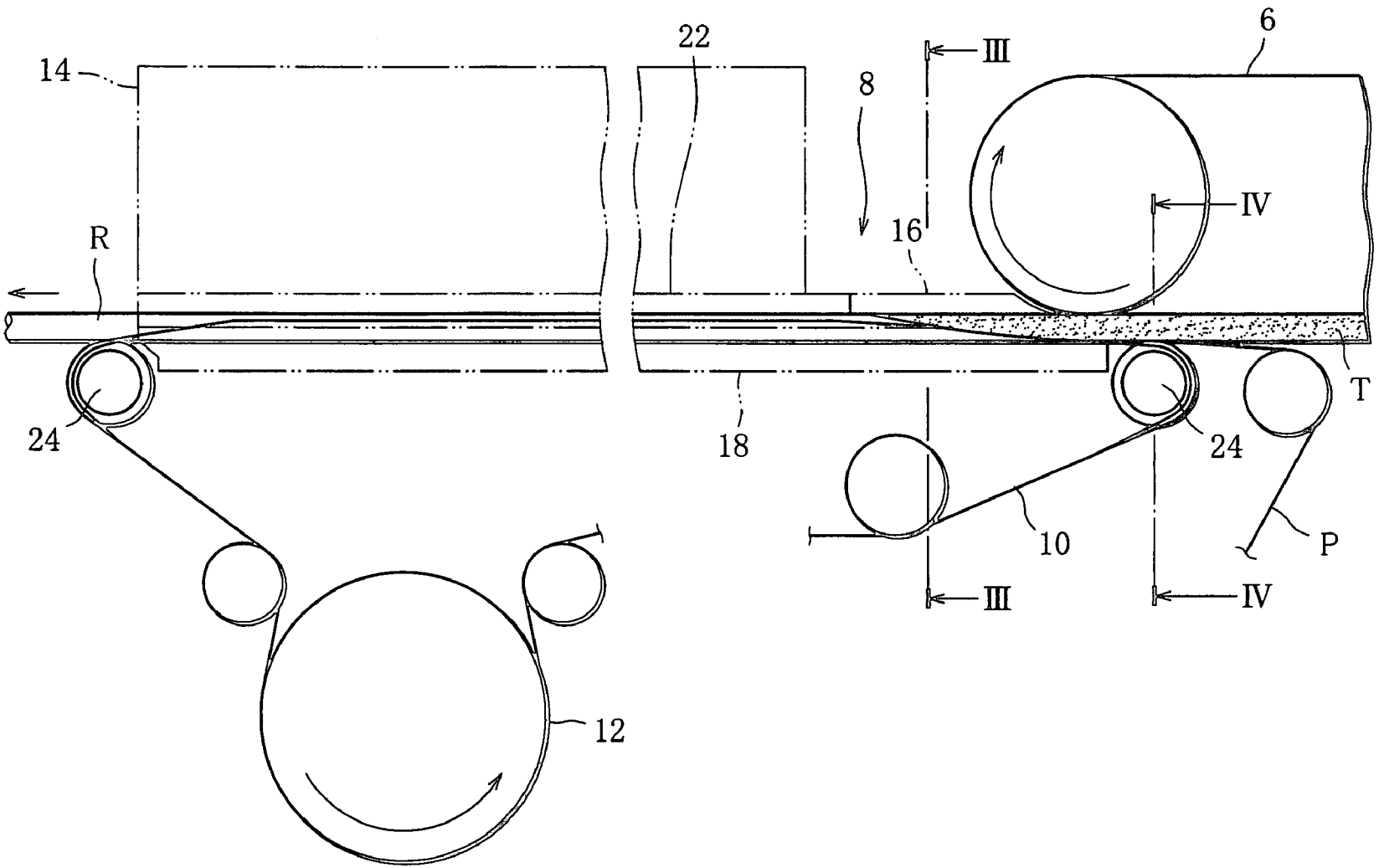
FIG. 2 is a schematic view showing a process of forming a cigarette rod by means of the rod forming device.

FIG. 2 schematically illustrates a process of forming a cigarette rod R by means of the rod forming device 4. The wrapping paper P is supplied onto an upper surface of the garniture tape 10 at the upstream side of the position where the garniture tape 10 is directed upward. The rod forming device 4 causes the wrapping paper P to run with the garniture tape 10 and receives the shredded tobacco layer T by transferring the shredded tobacco layer T from the terminal end of the tobacco band 6 onto the wrapping paper P. Thereafter, the shredded tobacco layer T is moved to the wrapping section 8 with the wrapping paper P, and is then compression-molded into a round rod-shape by a compression mold 16 including a shoe and a tongue.

There is disposed a forming guide 18 in the wrapping section 8, the forming guide 18 extending along the travel path of the garniture tape 10 in the horizontal direction. The forming guide 18 supports a back surface of the garniture tape 10 and gradually bends the garniture tape 10 and forms the tape 10 into an arc shape in view of the cross-section thereof during the travel of the garniture tape 10 through the wrapping section 8.

Figure 3:
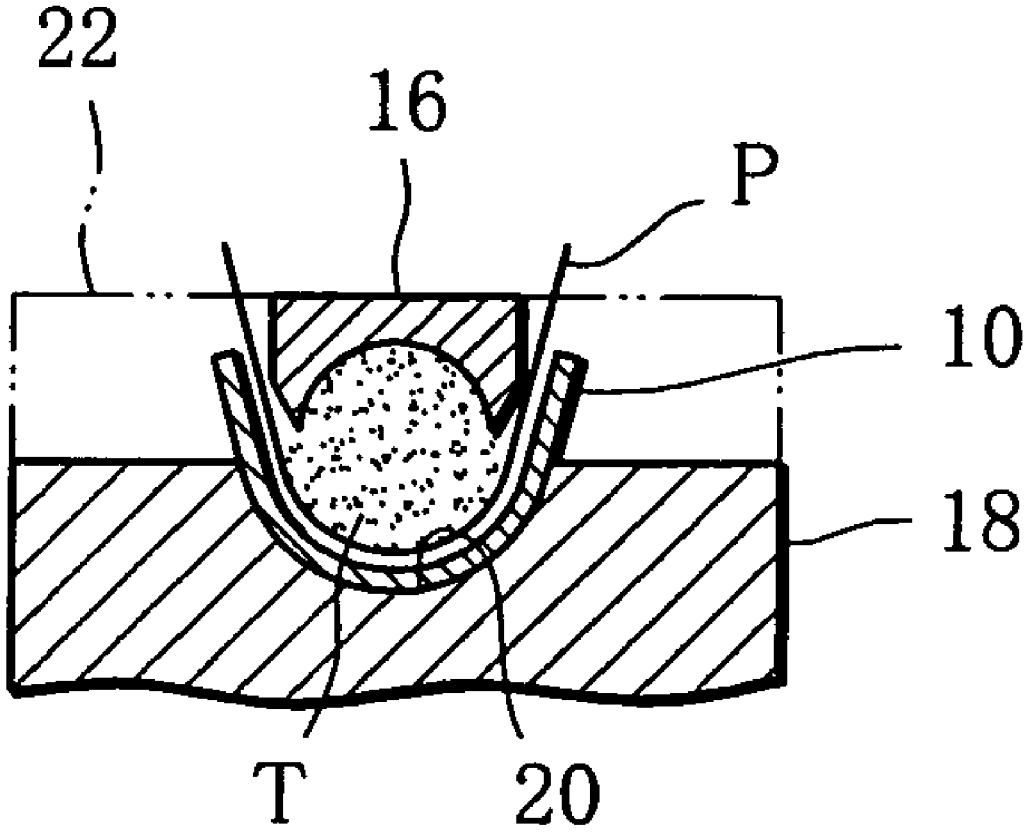
FIG. 3 is a sectional view of a compression mold, a forming guide and others, taken along line III-III in FIG. 2.

FIG. 3 shows the wrapping of the wrapping paper P around the shredded tobacco layer T in the wrapping section 8. A tape guiding groove 20 is formed on an upper surface of the forming guide 18 and extends from a terminal end area of the tobacco band 6 in the travelling direction of the garniture tape 10. The tape guiding groove 20 emerges from the terminal end area of the tobacco band 6 and has a cross section with a curvature radius gradually reducing toward the downstream side thereof. As a result, the cross section of the groove 20 ultimately converges to an approximate semicircle. Therefore, when the garniture tape 10 passes the inside of the tape guiding groove 20, the garniture tape 10 is supported by the forming guide 18 at the back surface thereof and bent so that the cross-sectional shape thereof is transformed into an arc that is convex downward along the cross section of the tape guiding groove 20.

At this moment, the wrapping paper P is pressed against the garniture tape 10 together with the shredded tobacco layer T and bent into a U-shape in view of the cross section thereof by the garniture tape 10. This enables the forming guide 18 to assist the wrapping of the shredded tobacco layer T in the wrapping paper P.

On the forming guide 18, upper molds 22 referred to as a short holder and a long holder are located on the downstream side of the compression mold 16. The upper molds 22 bend both side edges of the wrapping paper P bent into a U-shape in turn. In the meantime, seam paste is applied to the left side edge of the wrapping paper P in view of the travelling direction thereof, and then the wrapping paper P is formed into a tube to wrap the shredded tobacco layer T.

Due to the wrapping of the wrapping paper P, the left side edge is overlapped on the right side edge of the paper P, and these side edges are bonded to each other with the seam paste. Thereafter, the seam paste is dried in the aforementioned dryer section 14, thus forming continuously a cigarette rod R. The cigarette rod R is cut into double length cigarettes of double length equal to two cigarettes at a cut section not shown. These double length cigarettes are supplied from the cigarette manufacturing machine to a filter attachment machine not shown.

The curvature radius of the tape guiding groove 20 is gradually increased from the upstream side of a terminal end of the dryer section 14, and the tape guiding groove 20 vanishes at the terminal end of the dryer section 14.

In the travel path of the garniture tape 10, more specifically, in the horizontal region thereof passing the wrapping section 8 and the dryer section 14, the travel of the garniture tape 10 is guided by a pair of guide rollers 24. These guide rollers 24 are arranged at the upstream side of the wrapping section 8 and at the downstream side of the dryer section 14, respectively, so that the wrapping section 8 and the dryer section 14 are interposed between the guide rollers 24.

Figure 4:
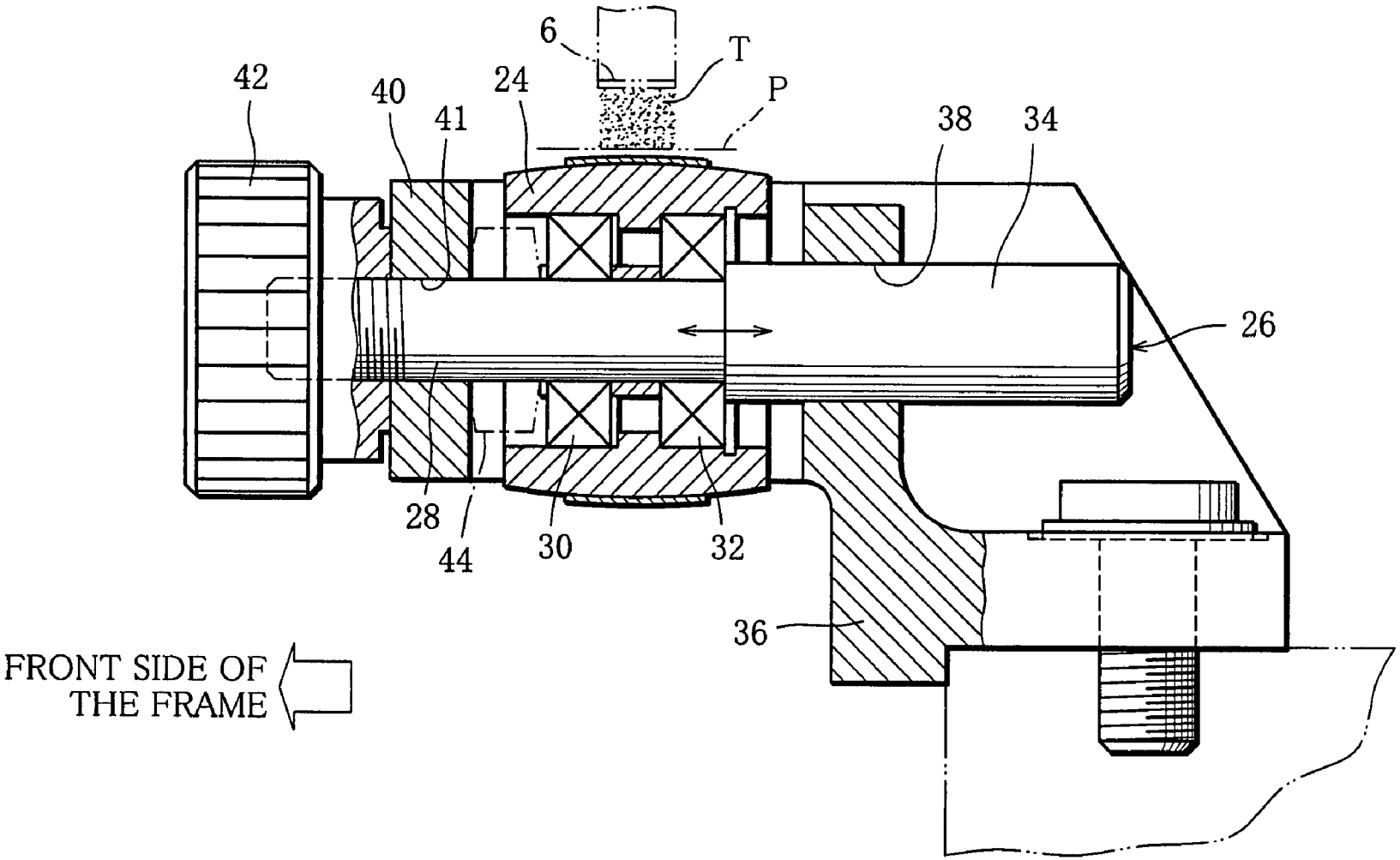
FIG. 4 is a sectional view of a guide roller, taken along line IV-IV in FIG. 2.

FIG. 4 illustrates a construction of the guide roller 24 in detail. The guide roller 24 includes a guide surface on the outer circumference thereof, the guide surface having the cross section of an arc, and the upper-side of the cross section is reverse to the cross section of the tape guiding groove 20 of the forming guide 18, namely convex upward, in the travelling direction of the garniture tape 10.

The guide roller 24 has a roller shaft 26 at the center thereof, the roller shaft 26 extending in a transverse direction of the travel path. The roller shaft 26 is shaped into a stepped form and rotatably supports the guide roller 24 through two bearings 30 and 32. These bearings 30 and 32 are mounted on the small diameter portion 28 of the roller shaft 26. The large diameter portion 34 of the roller shaft 26 is located in the backside of a frame of the cigarette manufacturing machine, extends to a bracket 36 and penetrates the same. The bracket 36 has a through-hole 38 capable of receiving the large diameter portion 34 of the roller shaft 26. In this state, the roller shaft 26 can slide along the axial direction of thereof in the through-hole 38. The bracket 36 is fixed to the frame of the cigarette manufacturing machine at a base part thereof.

On the other hand, the small diameter portion 28 of the roller shaft 26 extends toward the front side of the frame and penetrates a shaft support 40. A through-hole 41 is also formed in the shaft support 40 to receive the small diameter portion 28. In this state, the roller shaft 26 can slide in the axial direction thereof in the through-hole 41. Moreover, the roller shaft 26 is prevented from rotating around the axis thereof by a rotation stopper not shown.

A tip end of the small diameter portion 28 is worked into a threaded portion. The threaded portion protrudes from the shaft support 40 and is screwed into an adjustment dial 42. The shaft support 40 has a portion located at lower position than the guide roller 24 or the inner side of the travel path. The lower part is bent toward the backside of the frame and is connected to the bracket 36.

Further, the small diameter portion 28 is surrounded with a coned disc spring 44 as resilient member. The coned disc spring 44 is interposed between the shaft support 40 and the bearing 30. Although utilized in the embodiment shown in FIG. 4 is the coned disc spring 44, the resilient member is not functionally limited to the coned disc spring 44, and for example, a coil spring may be utilized instead.

The coned disc spring 44 is given initial compressive force in an illustrated set condition and pushes the bearing 30 toward the backside of the frame due to repulsive force thereof, with respect to the shaft support 40. Furthermore, the repulsive force of the coned disc spring 44 is transmitted to the roller shaft 26 through the bearings 30 and 32, and the like, and causes the roller shaft 26 to slide toward the backside of the frame with respect to the bracket 36. Meanwhile, the adjustment dial 42 is in contact with the shaft support 40 at the front side of the frame due to the repulsive force of the coned disc spring 44, thereby preventing the slide of the roller shaft 26. Therefore, if the adjustment dial 42 is rotated, the threaded portion is moved in the axial direction with respect to the adjustment dial 42, making it possible to cause the roller shaft 26 to slide in the axial direction with respect to the bracket 36. At this moment, a fine adjustment can be made in a sliding amount of the roller shaft 26 according to a rotation angle of the adjustment dial 42, and thus the guide rollers 24 can be positioned in the transverse direction of the garniture tape 10 with respect to the travel path thereof (positioning mechanism).

As illustrated in FIG. 4, when being guided by the guide rollers 24, the garniture tape 10 is bent along the guide surfaces of the guide rollers 24 in view of the width direction of the tape 10.

At this moment, the garniture tape 10 is bent to have the cross section of an arc that is convex in reverse to the cross section of the tape guiding groove 20 of the forming guide 18 in the travelling direction thereof, thereby being brought into a state where the both side edges are curved downward with respect to the wrapping paper P. Thereafter, as described above, since the garniture tape 10 is bent to have the cross section of an arc that is convex downward along the tape guiding groove 20, the both side edges of the garniture tape 10 is warped upward in the wrapping section 8 on the contrary.

Figure 5:
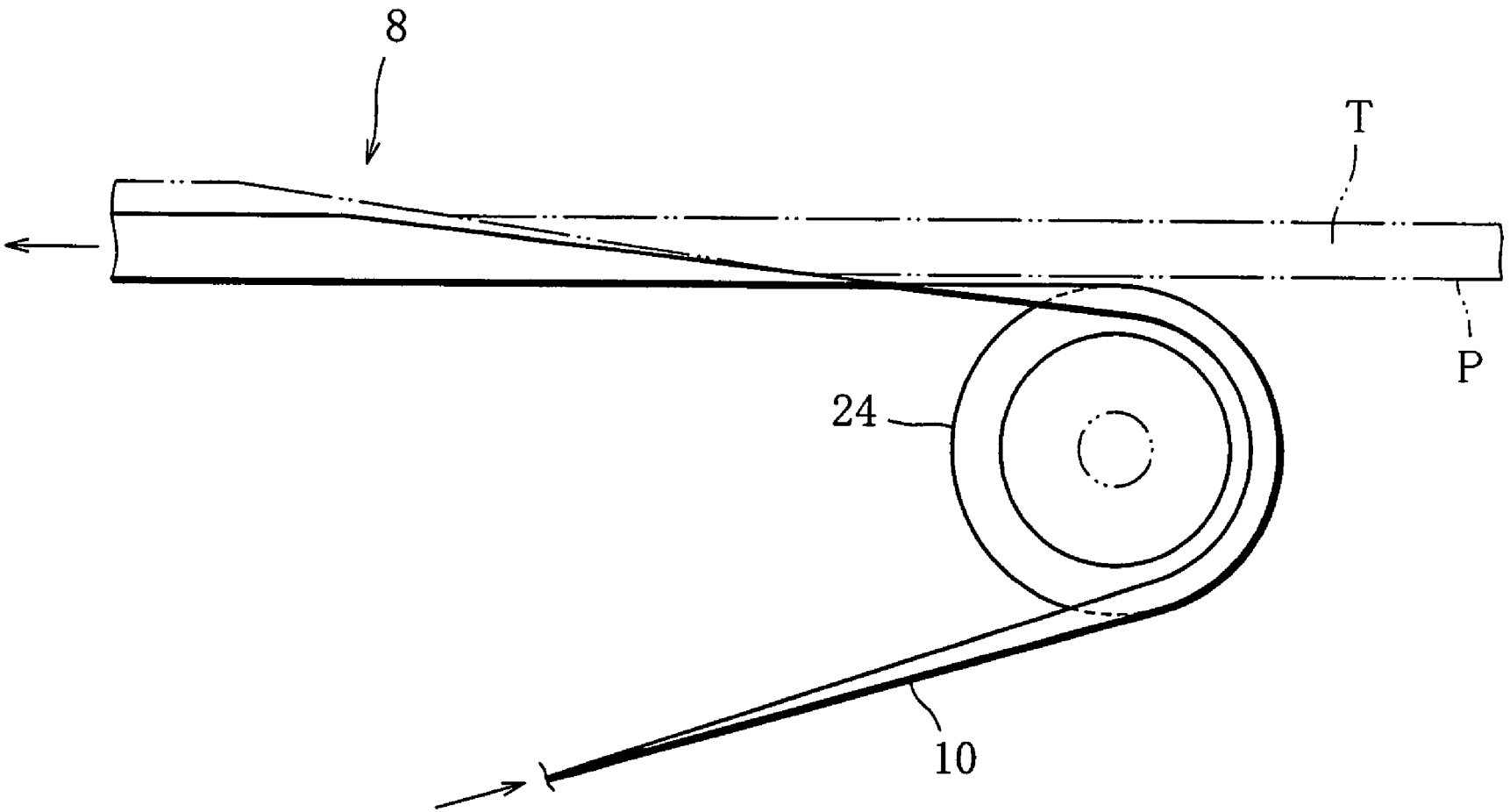
FIG. 5 is an enlarged view showing the vicinity of an inlet that continues to a wrapping section.

FIG. 5 is an enlarged view showing the vicinity of the inlet that continues to the wrapping section 8 in the travel path of the garniture tape 10. When the garniture tape 10 passes through the wrapping section 8, the both side edges thereof are curled up toward the outside of the travel path, that is, upward. As a result, the both side edges have greater travel length than the central part of the tape 10 in the travel path or the wrapping section 8. On the contrary, the both side edges of the garniture tape 10 are pulled toward the inner side of the travel path more than the central part is, in contacting regions where the tape 10 is passed around the guide rollers 24 and in the vicinities of the regions. Therefore, the both side edges have smaller travel length than the central part in the contacting regions and the vicinities thereof. Thus, a difference of the travel length between the both side edges and the central part of the garniture tape 10, that is generated in the wrapping section 8, is offset by the guide rollers 24. Consequently, in the course including the wrapping section 8 and the vicinities of the guide rollers 24, the travel length between the both side edges and the central part of the garniture tape 10 is uniform.

As described above, since the difference of the travel length between the both side edges and the central part of the garniture tape 10 disappears, the distribution of tension on the garniture tape 10 becomes uniform in the width direction thereof. Therefore, neither side edge of the garniture tape 10 intensively receives excessive tension in the wrapping section 8. In order to make the tension on the garniture tape 10 uniform, it is preferable that the disappearance of difference of the travel length by using the guide rollers 24 be as complete as possible. To this end, it is desirable that the cross section (curvature radius) of the guide roller 24 be determined in consideration of the increment of the travel length of the both side edges, that is produced by the forming guide 18, and the decrement the travel length by the guide rollers 24.

Since the guide roller 24 has the outer circumference of a convex, the garniture tape 10 tends to travel on the center of the guide rollers 24 by so-called self-aligning (centering) action. As a result, the garniture tape 10 can travel while maintaining its position with respect to the travel path, and is therefore effectively prevented from meandering.

Since the garniture tape 10 travels on the center of the guide rollers 24 as mentioned above, the positioning of the guide rollers 24 in the transverse direction of the travel path makes it possible to actively adjust the travel position of the garniture tape 10 with respect to the forming guide 18.

Although the guide rollers 24 are individually located at the upstream and downstream sides of the wrapping section 8 in the above embodiment, more than one guide roller 24 may be disposed at the both sides of the wrapping section 8. Additionally, another guide member may be utilized instead of the guide roller 24. For example, a plurality of plain rollers may be aligned in the axial direction thereof, and these rollers may be so disposed as to form an arch roller train that is upward convex in the travelling direction of the garniture tape 10.

Furthermore, the mechanism for positioning the guide rollers 24 in the transverse direction of the travel path is attainable also under the condition where components thereof are properly exchanged or modified.

In addition, the forming device of the present invention can be applied not only to the cigarette manufacturing machine but also as a filter rod manufacturing machine.

The rod-shaped article forming device of the present invention effectively prevents damages to the both side edges of the garniture tape and the meander thereof, thereby suppressing the shortening of the useful life of the tape. This makes it possible to use the garniture tape within its original useful life to the full, thereby greatly contributing to improvement of operation efficiency of the cigarette manufacturing machine, filter rod manufacturing machine, etc.

When the forming device performs the travel guidance of the garniture tape through a pair of guide rollers, the self-aligning action enables the stable travel of the garniture tape and the secure wrapping of the material or filler to be wrapped in the wrapping paper. The guide roller can be easily applied to existing equipment including cigarette and filter rod manufacturing machines and the like, so that the application of the present invention can be realized by only simple adaptation.

Moreover, so long as the cross section of the guide roller is determined according to the forming guide, the concentration of tension on the both side edges of the garniture tape can be properly relieved.

Furthermore, when the forming device comprises the mechanism for positioning the guide rollers, the travel position of the garniture tape can be actively adjusted with respect to the forming guide, making it possible to set the optimum conditions for forming the rod-shaped article in the forming device.

The invention claimed is:

1. A rod-shaped article forming device comprising:

a travel path along which an endless garniture tape travels while passing through a wrapping section thereof, a forming guide disposed in the wrapping section of said travel path to support a back surface of the garniture tape, said forming guide bending the garniture tape during a travelling process thereof to form the garniture tape into an arc in view of a cross section thereof, thereby wrapping in wrapping paper a material supplied onto the wrapping paper in a travelling process of the wrapping paper together with the garniture tape to continuously form a rod-shaped article, and a pair of guide members for guiding the garniture tape at upstream and downstream sides of the wrapping section of said travel path, forming the garniture tape, in view of a cross section thereof, into a arc that is convex in reverse to a cross section thereof formed by said forming guide, and guiding the garniture tape while pulling both side edges thereof more than a central part thereof toward an inner side of said travel path in order to offset an increment of tension that is produced on the both side edges of said garniture tape due to the guidance of said forming guide, wherein said guide members are a pair of guide rollers arranged in upstream and downstream sides of the wrapping section with the wrapping section interposed therebetween in said travel path, the guide rollers each including a guide surface having a cross section of an arc that is convex in reverse to a cross section of said garniture tape formed by said forming guide in a travelling direction of the garniture tape, and further comprising a positioning mechanism capable of positioning said guide rollers with respect to a transverse direction of said travel path.

2. The rod-shaped article forming device according to claim 1, wherein said guide rollers each include the guide surface having the cross section that is so determined as to make travel length of the both side edges and that of the central part of the garniture tape on said travel path substantially uniform.

* * * * *